United States Patent [19]

Shang et al.

[11] 4,447,297

[45] May 8, 1984

[54] COMBINED FLUIDIZED BED RETORT AND COMBUSTOR

[75] Inventors: Jer-Yu Shang, Fairfax, Va.; John E. Notestein, Morgantown, W. Va.; Joseph S. Mei, Morgantown, W. Va.; Li-Wen Zeng, Morgantown, W. Va.

[73] Assignee: The United States of America as represented by the United States Department of Energy, Washington, D.C.

[21] Appl. No.: 368,197

[22] Filed: Apr. 14, 1982

[51] Int. Cl.[3] ..... C10B 1/06; C10B 49/10; C10B 49/22

[52] U.S. Cl. ..... 202/99; 201/31; 202/215; 432/58

[58] Field of Search ..... 202/84, 88, 89, 93, 202/99, 108, 129, 208, 215; 201/31; 48/197 A, 206; 432/15, 58

[56] References Cited

U.S. PATENT DOCUMENTS

| | | | |
|---|---|---|---|
| 2,527,198 | 10/1950 | Rollman | 48/206 |
| 2,717,867 | 9/1955 | Jewell et al. | 201/31 |
| 4,082,615 | 4/1978 | Komuro et al. | 202/215 |
| 4,233,024 | 11/1980 | Plass | 432/58 |
| 4,274,941 | 6/1981 | Janssen et al. | 201/31 |
| 4,324,620 | 4/1982 | Ito et al. | 202/89 |
| 4,337,066 | 6/1982 | Kunii | 48/206 |

FOREIGN PATENT DOCUMENTS

| | | | |
|---|---|---|---|
| 2946102 | 5/1981 | Fed. Rep. of Germany | 202/99 |

*Primary Examiner*—Bradley Garris

*Attorney, Agent, or Firm*—Earl L. Larcher; Stephen D. Hamel; Richard G. Besha

[57] ABSTRACT

The present invention is directed to a combined fluidized bed retorting and combustion system particularly useful for extracting energy values from oil shale. The oil-shale retort and combustor are disposed side-by-side and in registry with one another through passageways in a partition therebetween. The passageways in the partition are submerged below the top of the respective fluid beds to preclude admixing or the product gases from the two chambers. The solid oil shale or bed material is transported through the chambers by inclining or slanting the fluidizing medium distributor so that the solid bed material, when fluidized, moves in the direction of the downward slope of the distributor.

3 Claims, 6 Drawing Figures

COMBINED FLUIDIZED BED RETORT AND COMBUSTOR

BACKGROUND OF THE INVENTION

The present invention relates generally to the recovery of hydrocarbons by oil shale retorting and coal gasification, and more particularly to a retorting and combustion arrangement wherein oil shale is pneumatically displaced through a combined retorting and combustion system for effecting the sequential retorting and combustion thereof in an efficient manner.

In oil shale retorting operations, the heat of combustion of hydrocarbons in the oil shale has been used to provide the heat source necessary for effecting the "driving off" (retorting) of the hydrocarbons from the oil shale. The use of a retort with a moving bed, countercurrent solid/gas flow arrangement has been used for this purpose and has provided a substantial advancement in oil shale retorting operations as well in coal gasification processes. In the moving bed retort, the combustion of hydrocarbons in the oil shale takes place near the bottom of the moving bed with resulting hot gases rising through the overlying bed material into a zone where the oil shale retorting takes place. The close proximity between the retorting zone and the underlying combustion zone provides efficient heat transfer between the hot gases and the oil shale especially since this heat transfer takes place in a countercurrent flow mode. This particular heat transfer relationship is one of the main features of this type of moving bed retort.

While the aforementioned solid/gas, retorting-combustion system and other similar systems have achieved some success in oil shale retorting, there are several attendant problems or shortcomings which detract from the efficiency and overall success of these systems. As pointed out above, the combustion zone of a moving bed retort is near the bottom of the housing and as the hot combustion gases rise through the overlying packed column, the sensible heat from the combustion process retorts the oil shale by forcing the kerogen in the shale to decompose through a destructive process into recoverable gaseous hydrocarbons. The inherent variation within the packed bed or column of oil shale in this retorting process causes some nonuniform distribution of the hot combustion gases rising therethrough, particularly in large bed facilities where large quantities of solids are packed into a column in a countercurrent, heat-exchange relationship with the gaseous products of combustion. In such facilities, whenever an obstruction to the gaseous flow through the overlying solids occurs, the rising gases form channels through the solids in areas having the least resistance to flow. When such channeling occurs, an excessive portion of the oil shale will not be adequately retorted since the temperature distribution through the oil shale bed is no longer sufficiently uniform. Thus, oil shale retorting becomes somewhat inefficient by using moving bed retort techniques, especially on a relatively large scale as would be used in commercial applications.

SUMMARY OF THE INVENTION

It is the primary aim or objective of the present invention to provide a combined retorting and combustion system wherein the retorting and combustion takes place in a single vessel by providing an arrangement by which the fluidized solid material (coal or oil shale) is pneumatically displaceable from the retorting chamber into the combustion chamber without admixture of the gases emanating from either chamber. This objective is achieved by a fluidized bed retorting and combustion apparatus which comprises a housing containing a vertically oriented partition means for dividing the housing into side-by-side volumes. A perforated fluidizing gas distribution means or grid is disposed in each of the volumes on a near horizontal plane. One of these adjacent chambers is defined as a retorting chamber and the other is defined as a combustion chamber. Passageway means for solids is provided through the partition means at a location above the distribution means for placing the adjacent chambers in registry with one another. Means are operatively associated with the distributor means for effecting a dynamic effect within the fluidizable solid material contained within each of the chambers for displacing or moving the solid material from chamber to chamber through the passageway means. The means or mechanism by which the fluidizable bed material within the vessel is displaced in a somewhat circular manner from chamber to chamber through the passageway means in the partition is achieved by slanting the distribution means at a sufficient angle so that the bed material dynamically flows in a direction from the highest point in the vessel above the distribution means towards the lowest point in the vessel. Another mechanism for effecting the displacement of the bed material is achieved by slanting the fluidizing gas nozzles or passageways through the distribution means in such a direction that the gas passing through the distribution means directs the bed material in the circular motion, i.e., from the retorting chamber into the combustion chamber with a portion of material being returned to the retorting chamber to facilitate retorting.

Other and further objects of the invention will be obvious upon an understanding of the illustrative embodiment about to be described or will be indicated in the appended claims, and various advantages not referred to herein will occur to one skilled in the art upon employment of the invention in practice.

Preferred embodiments of the invention have been chosen for the purpose of illustration and description. The preferred embodiments illustrated are not intended to be exhaustive or to limit the invention to the precise forms disclosed. They are chosen and described in order to best explain the principles of the invention and their application in practical use to thereby enable others skilled in the art to best utilize the invention in various embodiments and modifications as are best adapted to the particular use contemplated.

DETAILED DESCRIPTION OF THE INVENTION

Figure 1:
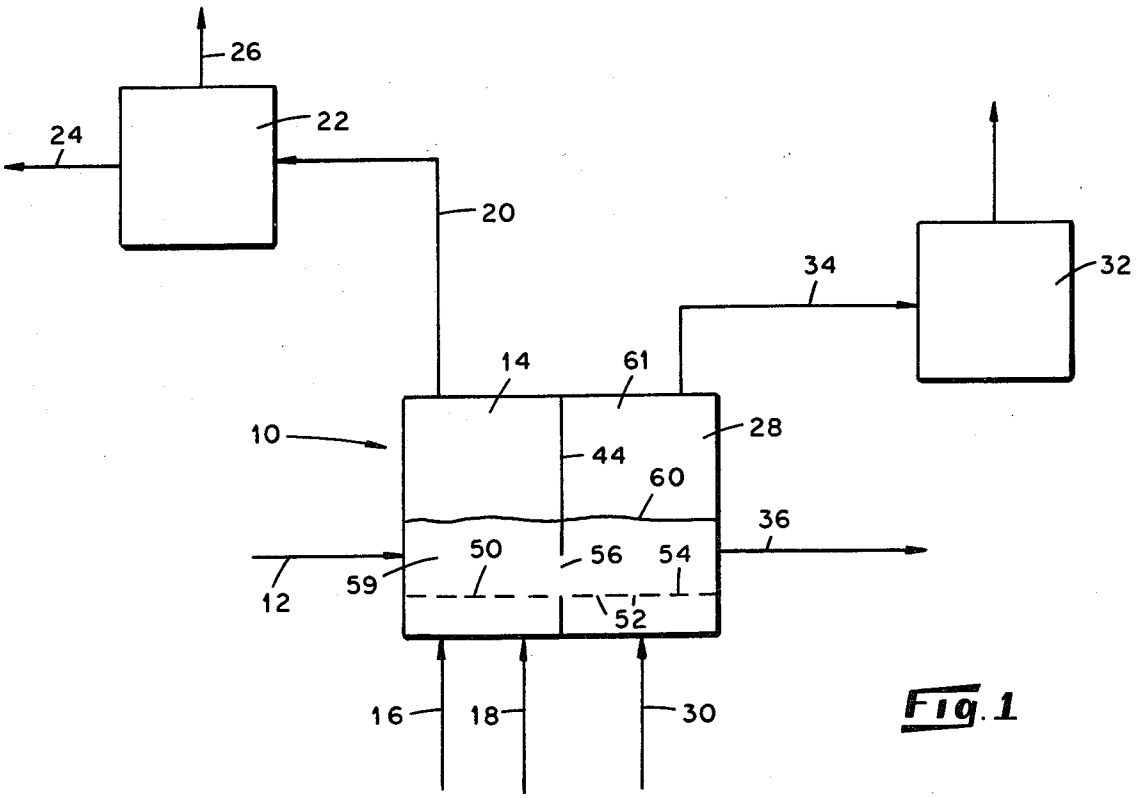
FIG. 1 is a schematic view showing the integrated or combined fluidized bed retorting and combustion system of the present invention.
Figure 2:
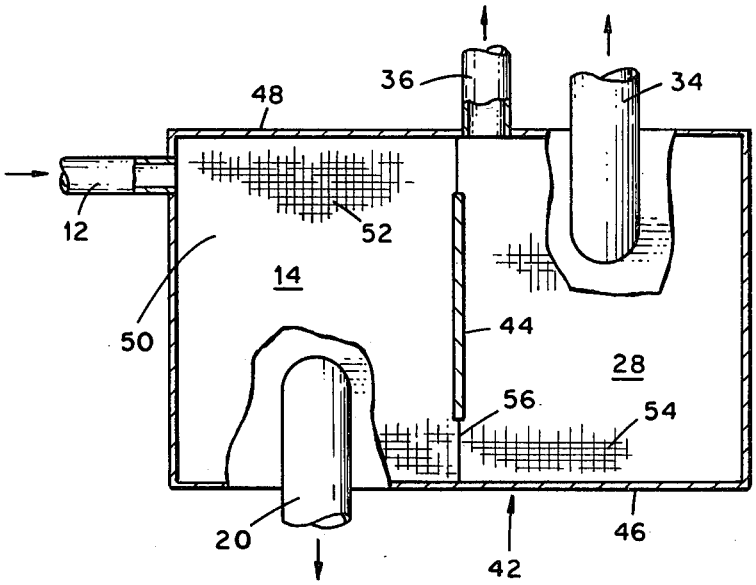
FIG. 2 is a sectional plan view showing details of the combined retorting and combustion vessel of the present invention.
Figure 3:
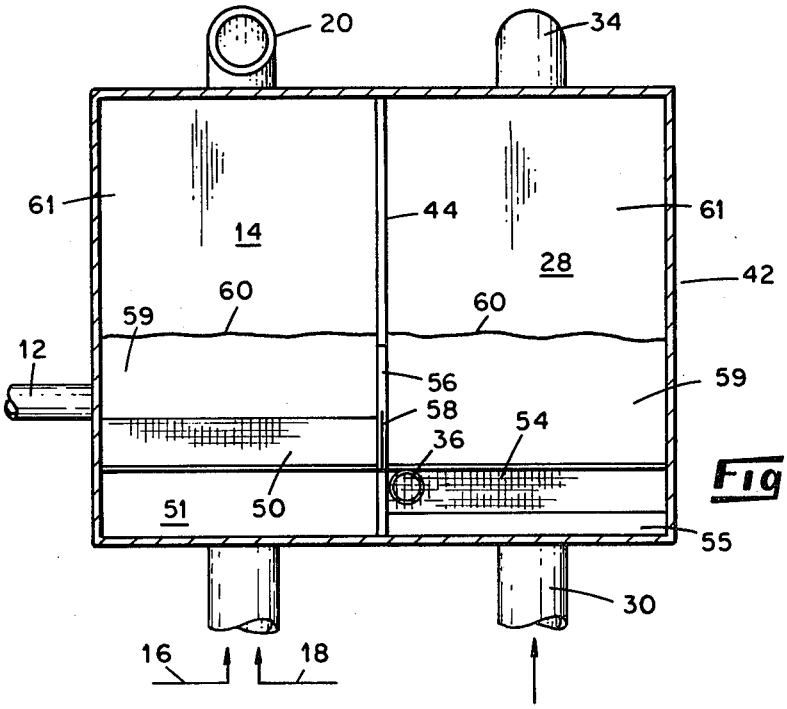
FIG. 3 is a sectional elevational view of FIG. 2.
Figure 4:
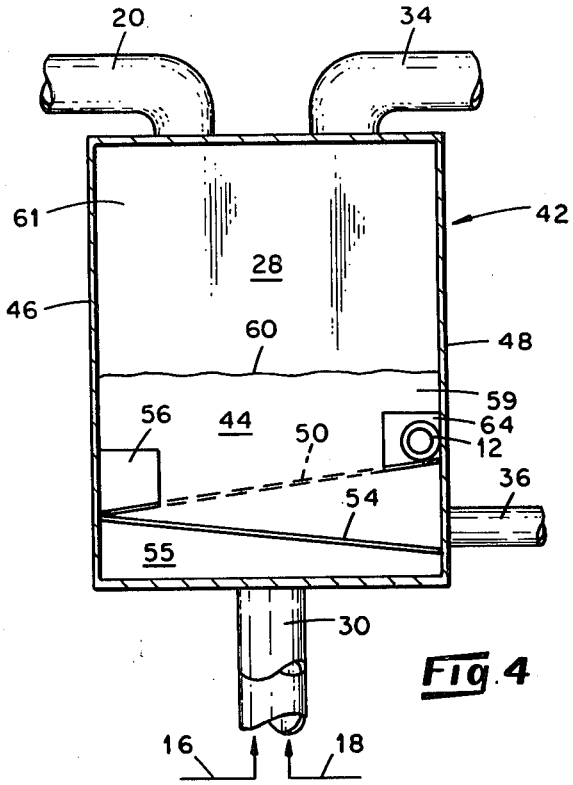
FIG. 4 is a side view of FIG. 2 showing the relationship of the slanted distribution means with respect to the partition means dividing the vessel into side-by-side chambers.

With reference to the accompanying drawings, the combined fluidized bed combustor and retort of the present invention is generally shown at 10 in FIG. 1. As will be described in detailed below, the fluidized bed retort and combustor 10 of the present invention is separated into side-by-side chambers by a partition having passageways therethrough which allows for the flow of the solid bed material between the chambers but inhibits the admixture of the gaseous products in one chamber with the gaseous products of the other chamber. In the operation of the combined retort and combustor 10, a conduit 12 is utilized for feeding crushed raw oil shale into the combustor and retort 10 for the recovery of hydrocarbons and the sensible heat therefrom. The oil shale enters the retorting chamber 14 where it is fluidized by a stream of inert gas through conduit 16 and steam through conduit 18. The inert gas may be made up of steam, nitrogen, carbon dioxide or other recoverable gas and the steam is at a temperature in a range of about 800° F. to 1750° F. The fluidized oil shale is adequately heated by the fluidizing gases and a portion of the solid products of combustion recycled from the combustor to effect the evolution of volatile hydrocarbons and the like therefrom. These gaseous products exit the retorting chamber 14 through conduit 20 into a hydrocarbon recovery facility 22 where liquids such as oil may be separated via conduit 24 while gaseous hydrocarbons usable for other energy-derived applications are conveyed from the recovery facility 22 by conduit 26.

After the oil shale is retorted, a quantity of carbon and other combustibles still remain in the oil shale. These combustibles are preferably burned in order to retrieve the sensible heat and chemical energy as well as to increase the efficiency of the retorting process by providing a heat source for the retort. The retorted oil shale is conveyed into the combustion chamber 28 where air or oxygen enriched air is introduced through conduit 30 for fluidizing the oil shale and for initiating combustion of the combustible material contained within the oil shale. Normally, the temperature of the oil shale exiting the retorting chamber is in the range of about 800°–1200° F. which is sufficient to initiate combustion of the combustibles upon contact with the oxygen containing combustion supporting gas introduced through conduit 30. The heat value in the flue gas derived from this combustion of the oil shale in combustion chamber 28 may be recovered in a suitable heat exchanger or waste heat boiler 32 coupled to the retort and combustor 10 by conduit 34.

Upon the combustion of the combustibles remaining in the oil shale, the spent oil shale is discharged through conduit 36 into a suitable repository (not shown). This spent material may be used for the manufacture of cement, heat recovery processes, and the like.

As best shown in FIGS. 2–5, the combined fluidized bed retort and combustor 10 of the present invention is shown comprising a housing 42 of a rectangular configuration, but could be of any suitable configuration such as circular, oval or the like. A vertically oriented partition 44 is centrally located within the housing 42 and extends between a front wall 46 and a back wall 48 of the housing 42 over the full height of the housing interior. As shown, the partition 44 divides the housing into the retorting chamber 14 and the combustion chamber 28 of essentially the same size. However, if desired the partition 44 may be suitably placed within the housing 44 to provide chambers of different sizes. A perforated gas distributor or grid 50 is disposed within the retorting chamber 14 and partially defines the retorting chamber 14 and fluidizing medium plenum chamber 51 underlying the distributor 50. The plenum chamber 51 may be provided with suitable vanes or other flow directing apparatus for the purpose of providing uniform or the desired distribution of flow of the fluidizing medium through perforations or passageways 52 through the distributor 50 into the retorting chamber 14. A distributor 54, with functions similar to distributor 50, is disposed in the combustion chamber 28 side of the housing 42 with this distributor 54 partially defining the combustion chamber 28 and a fluidizing medium plenum chamber 55 underlying the distributor 54 above the bottom wall of the housing 42.

The partition 44 is provided with a passageway 56 at a location above the distributors 50 and 54 at a point in the housing 42 remote to the oil shale-inlet conduit 12 and the spent solids discharge conduit 36. The bottom of this passageway 56 is flush with the distributors 50 and 54 while the top of the passageway 56 is disposed below the top of the fluidized bed level 60 to assure that the solid bed 59 material may pass from one chamber to the other while the gases within the freeboard region 61 of one chamber are inhibited from admixing with the gases from the other chamber.

In order to effect the movement or the displacement of the bed material 59 in a somewhat circular and continuous manner from the retorting chamber 14 into the combustion chamber 28 and eventually through the discharge conduit 36, the distributors 50 and 54 are slanted or tilted at a sufficient angle so that as the fluidizing medium passes through the perforations 52 in the distributors, the dynamic effect produced within the bed material 59 causes the latter to move within the chambers toward the direction of the low end of the distributors. This tilted-distributor arrangement assures that the bed material 59 will flow in a continuous and uniform manner from one chamber to the other and overcome or minimize the problems attendant with the moving bed system heretofore utilized for oil shale retorting.

As the oil shale is circulated from the retorting chamber 14 through the combustion chamber 28, a portion of the hot spent shale that is ready for discharge through conduit 36 is preferably reintroduced into the retorting chamber 14 for the purpose of facilitating the retorting action upon the fresh oil shale introduced through conduit 12. In order to achieve this recirculation of spent oil shale, a passageway 64 is provided through the partition 44 at a location adjacent the rear or back wall 48 of the retort and combustor housing 42 with this passageway 64 having the uppermost surface thereof disposed below the top or the fluidized bed level 60. With this arrangement about 10 to 90% of the spent shale is allowed to be recirculated into the retorting zone 14 for facilitating the retorting of the shale. This recirculation of spent shale is desirable since it immediately mixes with the raw shale and provides excellent heat transfer therebetween to rapidly initiate the retorting action.

The primary approach to solid circulation utilizes a tilted distributor which provides satisfactory results by being inclined in an angle in the range of about 4°. It is expected that an angle of inclination greater than about 4° would cause for too rapid of a displacement of the bed material from chamber to chamber while an angle less than about 4° would be insufficient for adequate movement of the shale.

Figure 5:
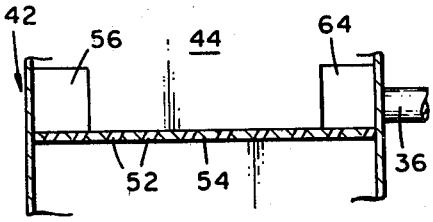
FIG. 5 is a fragmentary sectional view showing a variation of the "slanted nozzle" arrangement in the distribution means for imparting motion to the bed material within the retorting and combustion zones of the vessel.
Figure 6:
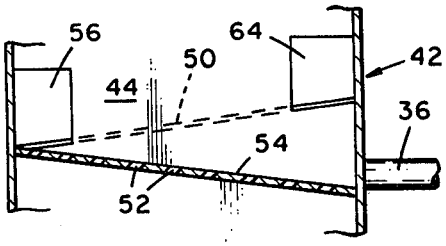
FIG. 6 is an illustration showing a further modification of the present invention in which the slanted nozzle arrangement of FIG. 5 is combined with the slanted distribution means of the embodiment shown in FIGS. 2–4.

As either an alternate or as an addition to the inclined distributors, the passageways or "nozzles" 52 through the distributors 50 and 54 may be canted or angled in the direction for effecting a pathway from the oil shale inlet 12 to the discharge 36 or in the direction of the downward slant of the distributors so that the fluidizing medium passing through the distributors provides an extra impetus for the purpose of displacing the bed material in the desired direction. This nozzle arrangement is shown in FIG. 5 where the canted nozzles 52 through the distributor are utilized with a level distributor. The use of the slanted nozzles 52 provides for adequate displacement of the solid bed material from chamber to chamber. However, it is preferable, as shown in FIG. 6, that the canted nozzles 52 be used with the inclined distributor for efficiently displacing the solid bed material.

As briefly mentioned above, the present invention is particularly suitable for the use in oil shale retorting but may be practiced with coal gasification processes where caking coals can be gasified for the purpose of recovering hydrocarbons and heat therefrom.

It will be seen that the present invention provides a mechanism which facilitates the retorting of oil shale in a manner which is more efficient than previously obtainable.

What is claimed is:

1. A combined fluidized bed retorting and combustion apparatus comprising a housing, vertically oriented partition means within said housing for dividing the housing into side-by-side volumes, perforated fluid distribution means in each of said volumes disposed essentially normal to said partition means for dividing each volume into lower and upper chambers with one of said upper chambers defining a retorting chamber and the other of said upper chambers defining a combustion chamber, said fluid distribution means providing for the distribution of fluidizing medium from the lower chambers into the retorting chamber and the combustion chamber through perforations in the fluid distribution means to fluidize solid fluidizable material and thereby create a fluidized bed in said retorting chamber and said combustion chamber, first conduit means penetrating said housing and in registry with said retorting chamber for conveying the solid fluidizable material thereinto, further conduit means penetrating said housing and in registry with said combustion chamber for removing solid material therefrom, first passageway means through said partition means at a location above the distribution means for placing the retorting chamber in registry with the combustion chamber, second passageway means extending through said partition means for recycling solid fluidizable material from the combustion chamber into the retorting chamber, with said second passageway means being disposed at a location in the housing adjacent to said further conduit means, the first passageway means extending through the partition means at a location remote to said second passageway means and at a location corresponding to essentially the full length of travel of the solid fluidizable material through said retorting chamber and both said first and second passageway means extending through said partition means at locations below the upper level of the fluidized bed to inhibit admixture of gases between said retorting chamber and said combustion chamber, said distribution means being inclined at an angle to the horizontal from the highest point adjacent to the first conduit means towards a lowest point adjacent to said further conduit means with said angle being adequate for effecting displacement of solid fluidizable material from within said retorting chamber through said combustion chamber via said first passageway means.

2. A combined fluidized bed retorting and combustion apparatus as claimed in claim 1, wherein the angle of inclination of said fluid distribution means is at an angle of about 4° from horizontal.

3. A combined fluidized bed retorting and combustion apparatus as claimed in claim 2, wherein the perforations through the distribution means are inclined at an angle with respect to the inclined distribution means that is adequate to supplement said displacement of the solid fluidizable material from within the retorting chamber through the combustion chamber via said first passageway means.

* * * * *